US006135815A

United States Patent [19]

Ko et al.

[11] Patent Number: 6,135,815

[45] Date of Patent: Oct. 24, 2000

[54] EMI SHIELD HAVING SELF-ALIGNING DEVICE

[75] Inventors: David Tso-Chin Ko, Thousand Oaks; Eric Juntwait, Irvine, both of Calif.

[73] Assignee: Hon Hai Precision Ind. Co., Ltd., Taipei Hsien, Taiwan

[21] Appl. No.: 09/196,859

[22] Filed: Nov. 20, 1998

[51] Int. Cl.[7] ..... H01R 13/648

[52] U.S. Cl. ..... 439/607; 439/95

[58] Field of Search ..... 439/607, 95, 608, 439/609

[56] References Cited

U.S. PATENT DOCUMENTS 4,938,704 7/1990 Fujiura ..... 439/95

5,125,853 6/1992 Hashiguchi ..... 439/607

5,863,222 1/1999 Kinsey et al. ..... 439/607

*Primary Examiner*—Brian Sircus

*Assistant Examiner*—Eugene G. Byrd

*Attorney, Agent, or Firm*—Wei Te Chung

[57] ABSTRACT

An EMI shield having a self-aligning device comprises a shroud portion defining a receptacle for receiving a mating portion of an inserted complementary connector. A first flange portion laterally extends around a bottom periphery of the shroud portion. The flange defines a plurality of holes for extension of locking bolts therethrough. Biasing tabs are integrally formed on side walls of the shroud portion and project into the receptacle for abutting against outer walls of a housing of the inserted complementary connector.

12 Claims, 10 Drawing Sheets

EMI SHIELD HAVING SELF-ALIGNING DEVICE

FIELD OF THE INVENTION

The present invention relates to an EMI shield, and more particularly to an EMI shield having a self-aligning device for facilitating insertion of a complementary connector.

DESCRIPTION OF PRIOR ART

FCC regulations dictate that power connectors for server suppliers and electronic bays must be shielded with an EMI shield, especially a high density power bay envelope in which eight plug power connectors are mounted to a 17"× 0.85" panel. Efficiently preventing cross-talk between the connectors on the power bay envelope is a critical issue.

Many connectors are provided with EMI shields, however, assembly of the EMI shield to a housing of a corresponding connector is achieved by tolerance therebetween. If the tolerance is too small, assembly of the EMI shield to the housing will be hindered. If the tolerance is too large, the EMI shield will not be securely assembled thereto.

SUMMARY OF THE INVENTION

An objective of this invention is to provide an EMI shield having a self-aligning device for facilitating assembly with a complementary connector.

In order to achieve the objective set forth, an EMI shield having a self-aligning device comprises a shroud portion defining a receptacle for receiving a mating portion of an inserted complementary connector. A first flange portion laterally extends from a bottom periphery of the shroud portion. The flange defines a pair of holes for the extension of locking bolts therethrough. Aligning means is integrally formed on the shroud portion and projects into the receptacle for abutting against outer walls of a housing of the complementary connector.

These and additional objectives, features, and advantages of the present invention will become apparent after reading the following detailed description of the preferred embodiment of the invention taken in conjunction with the appended drawings.

DETAILED DESCRIPTION OF PREFERRED EMBODIMENT

Figure 1A:
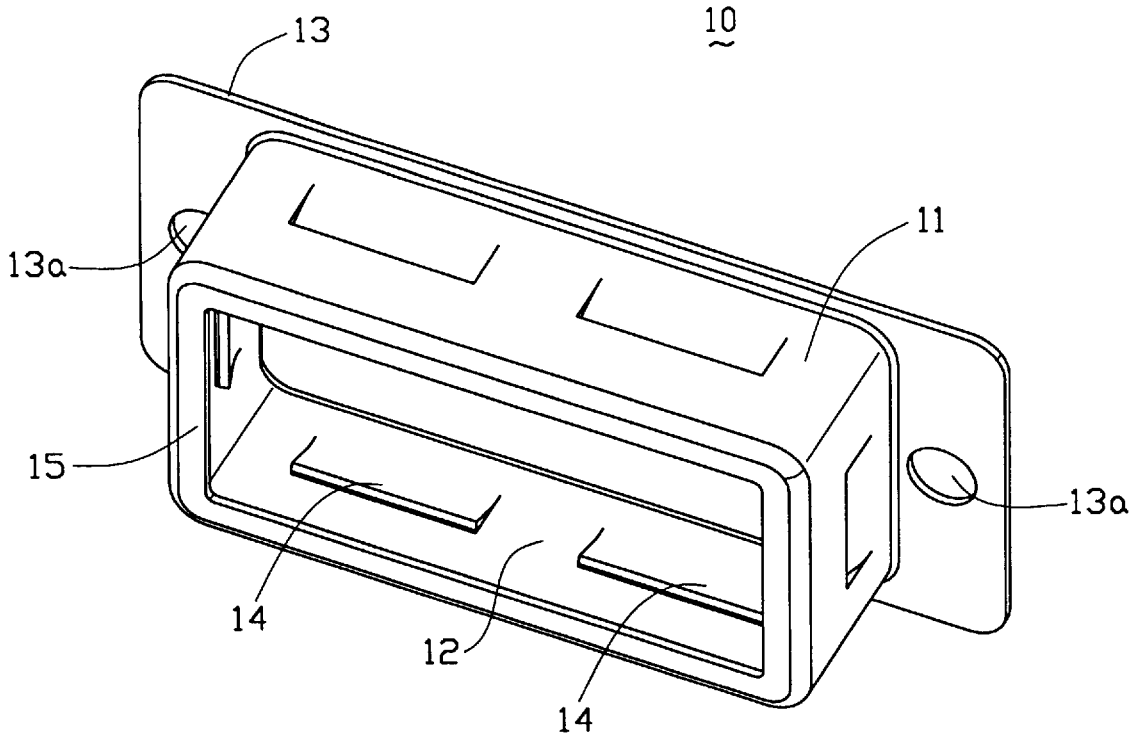
FIG. 1A is a perspective view of a first EMI shield.
Figure 1B:
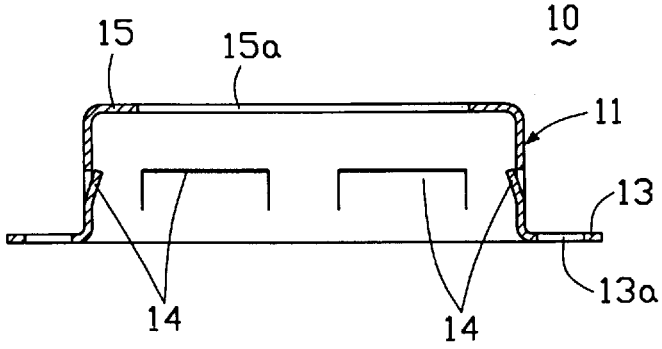
FIG. 1B is a cross sectional view of FIG. 1A.
Figure 1C:
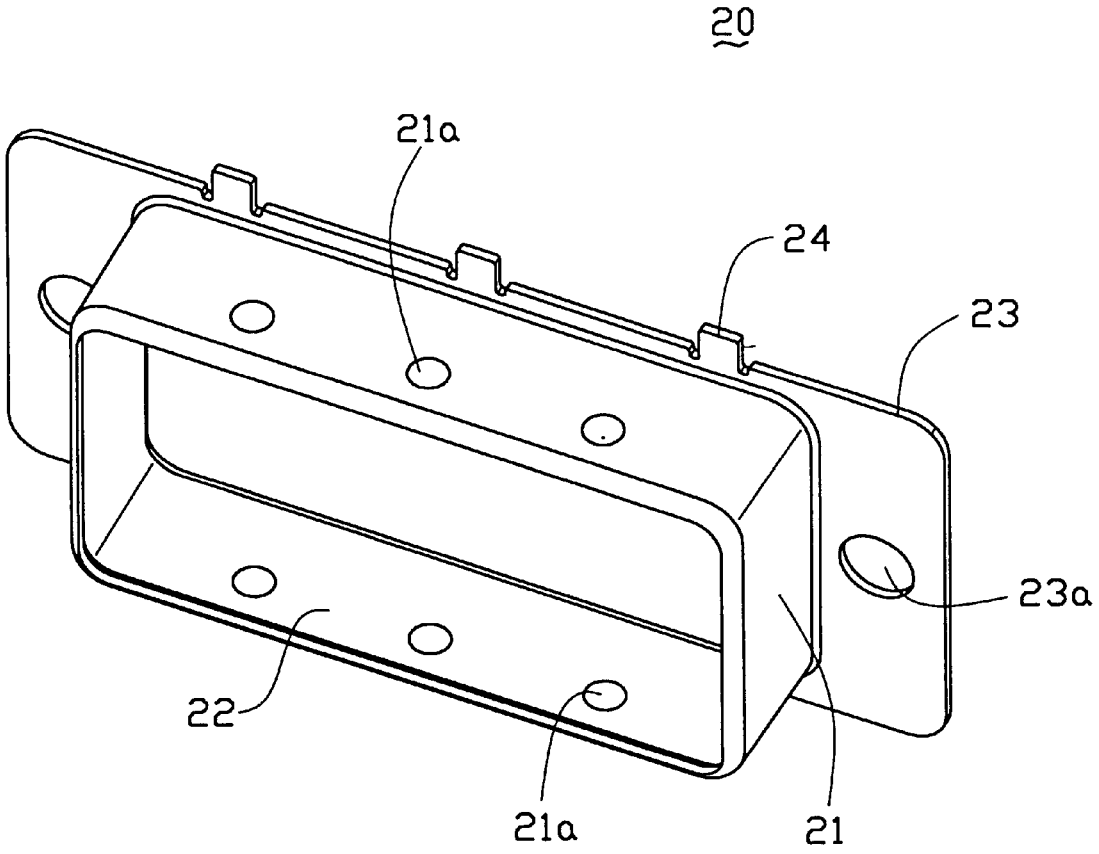
FIG. 1C is a perspective view of a second EMI shield assembled to the first EMI shield.
Figure 2A:
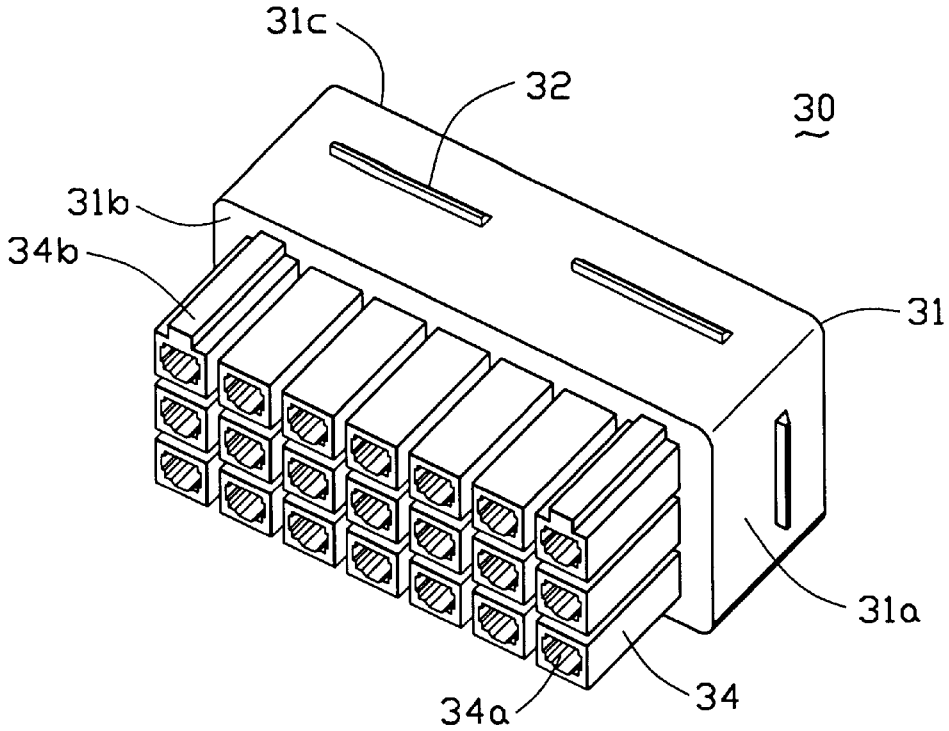
FIG. 2A is a perspective view of a housing of a first connector to be shielded by the first and second EMI shields without terminals therein.
Figure 2B:
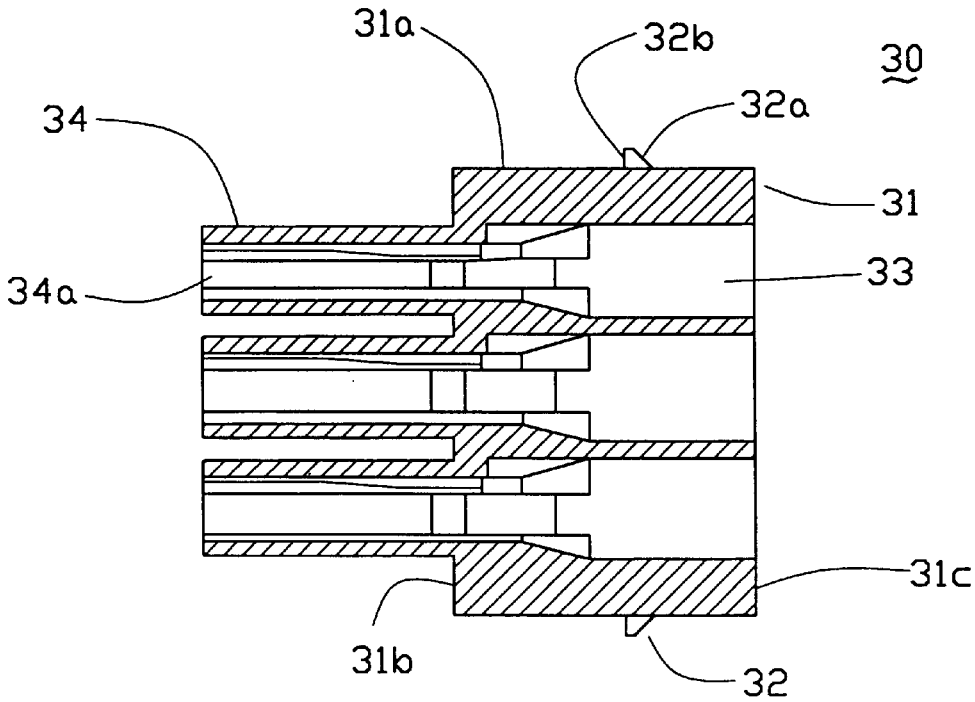
FIG. 2B is a cross sectional view of FIG. 2A.
Figure 2C:
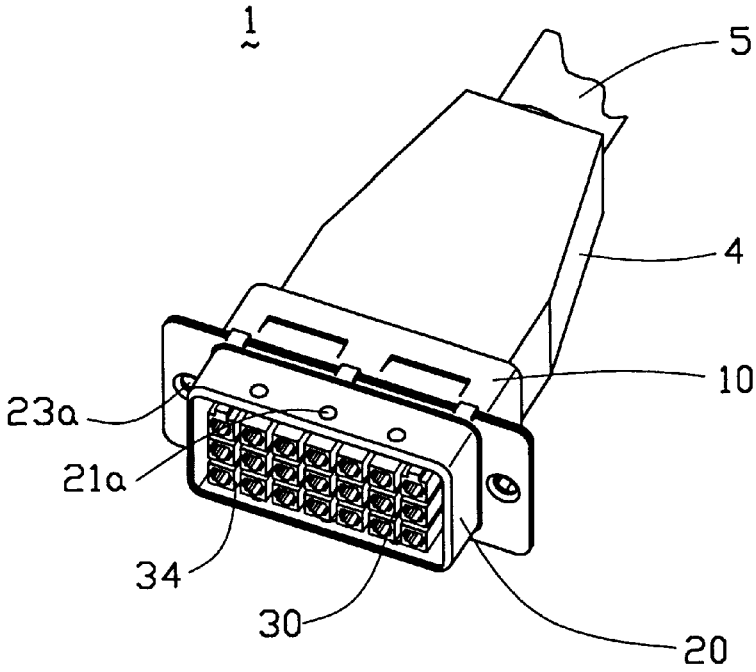
FIG. 2C is a perspective view of an assembly comprising the housing of the first connector and the first and second EMI shields of FIG. 2A.

Referring to FIGS. 1A, 1B, 1C, 2A, 2B, 2C, 2D, 5A, 5B and 5C, a first EMI shield 10 in accordance with the present invention includes a first shroud portion 11 defining a first receptacle 12 therein for receiving a housing 31 of a first connector 30. A first flange portion 13 laterally extends from a bottom periphery of the first shroud portion 11 and defines a pair of holes 13*a* for the extension of locking bolts 90 therethrough. Biasing tabs 14 are integrally formed on the first shroud portion 11 and project into the first receptacle 12 for engaging with ribs 32 formed on outer faces 30*a* of the housing 31 of the complementary connector 30. Each rib 32 includes an inclined surface 32*a* for facilitating insertion of the housing 31 into the first receptacle 12 of the first EMI shield 10, and a vertical portion 32*b* for engaging with the corresponding biasing tab 14. The biasing tabs 14 are formed on each wall of the first shroud portion 11 whereby when the housing 31 of the first connector 30 is inserted into the first receptacle 12 thereof, the housing 31 is centered within the first shroud portion 11. A second flange portion 15 inwardly extends from a top periphery of the first shroud portion 11 and defines a window 15*a* therein for extension of a wire harness (not shown) therethrough. The second flange 15 serves as a stopper to limit axial movement of the housing 31. By this arrangement, when the housing 31 of the first connector 30 is inserted into the first receptacle 12 of the EMI shield 10, the housing 31 is correctly aligned and positioned therein.

The first connector 30 includes the dielectric housing 31 having a mating face 31*b* and a rear face 3l*c* opposite the mating face 31*b*. An array of passageways 33 are defined between the mating and rear faces 31*b*, 31*c* for receiving conductive wires (not shown) therein. An array of sleeve members 34 extend from the mating face 31*b*. Each sleeve member 34 defines a terminal receiving cavity 34*a* therethrough aligned and communicating with the corresponding passageway 33. Terminals 71 (FIGS. 2D and 5B) of the conductive wires are assembled within the terminal cavity 34*b* through the passageways 33. Two opposite outermost sleeve members 34 are formed with keys 34*b*, respectively.

A second EMI shield 20 is assembled to the first EMI shield 10. The second EMI shield 20 includes a second shroud portion 21 defining a second receptacle 22 therein for shielding the array of sleeve members 34 of the first connector 30. The second EMI shield 20 includes a base flange 23 transversely extending from a bottom periphery of the second shroud portion 21. The base flange 23 defines a pair of holes 23*a* for the extension of the locking bolts 90 therethrough. The base flange 23 forms clips 24 extending from longitudinal sides thereof whereby when the second EMI shield 20 is assembled to the first EMI shield 10, the clips 24 are bent to clamp the first flange 13 of the first EMI shield 10. In assembly, the housing 31 is inserted into the first shroud portion 11 of the first EMI shield 10, then the second EMI shield 20 is assembled to the first EMI shield 10 thereby completely shielding the housing 31. The second shroud portion 21 forms dimples 21 a extending into the second receptacle 22 from side walls thereof. After the second EMI shield 20 is assembled to the housing 31, a receiving gap (not labeled) is defined between the second shroud portion 21 and the array of the sleeve members 34. A shell 4 for organizing the conductive wires and a cable 5 are further formed by a molding process to form a receptacle connector assembly 1.

Figure 4A:
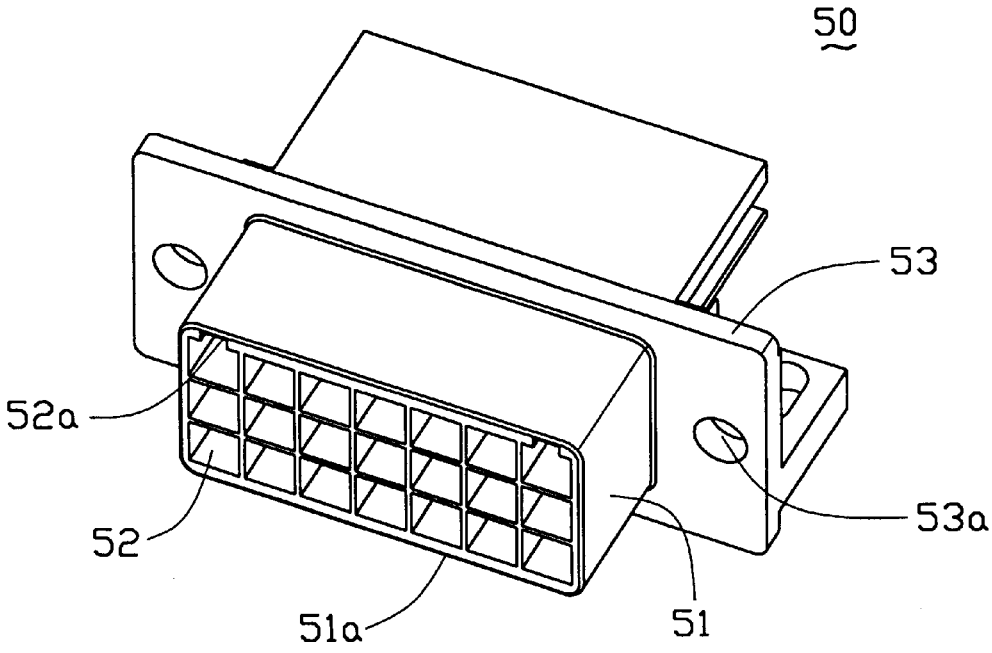
FIG. 4A is a perspective view of a second connector without the third EMI hield assembled thereto.
Figure 2D:
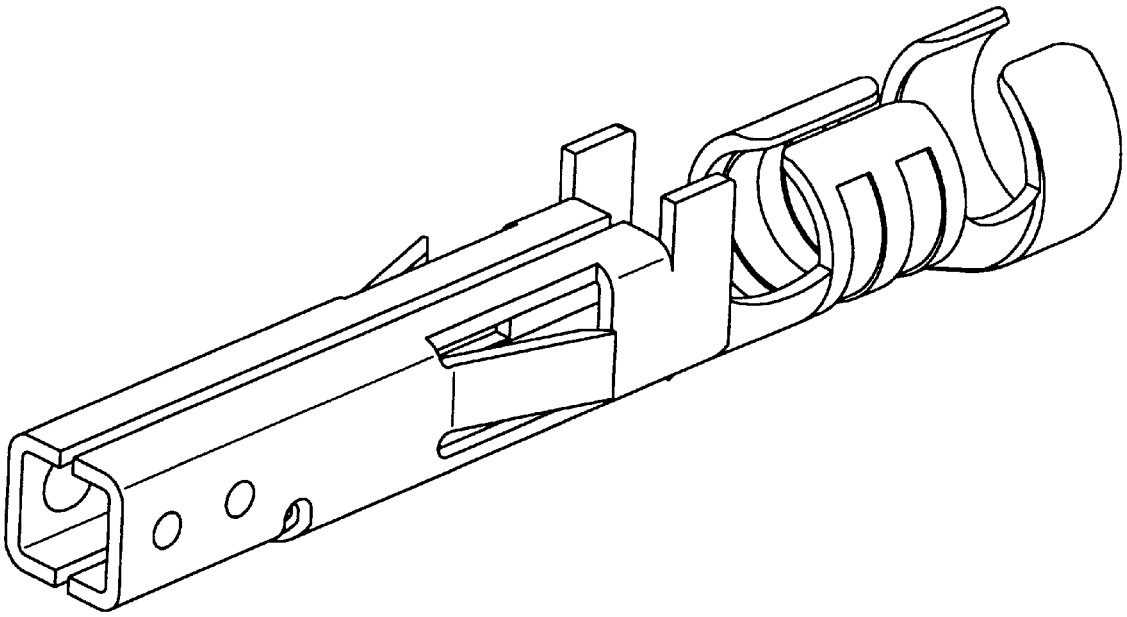
FIG. 2D is a perspective view of a terminal for use within the first connector.
Figure 3A:
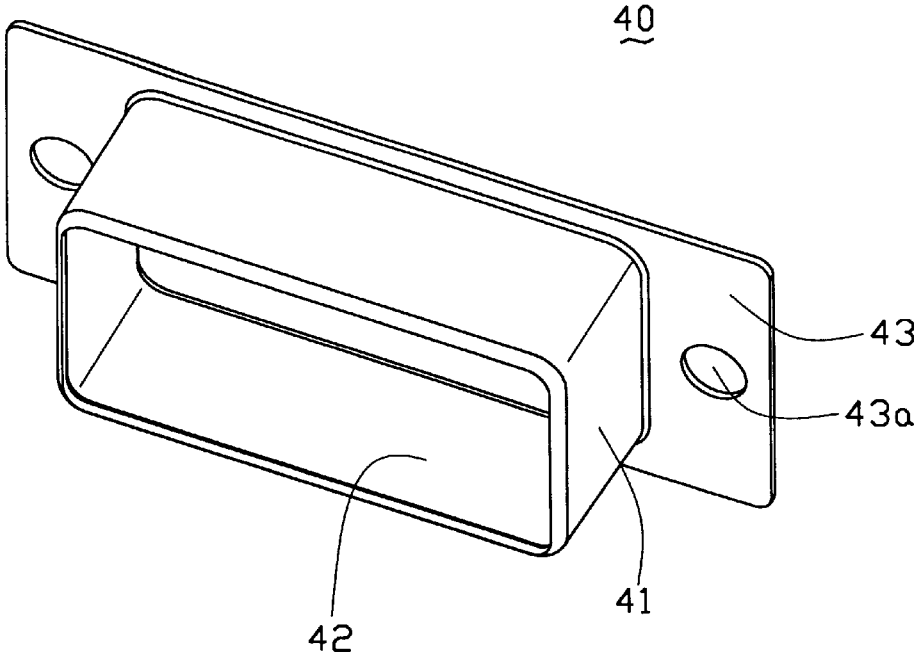
FIG. 3A is a perspective view of a third EMI shield.
Figure 3B:
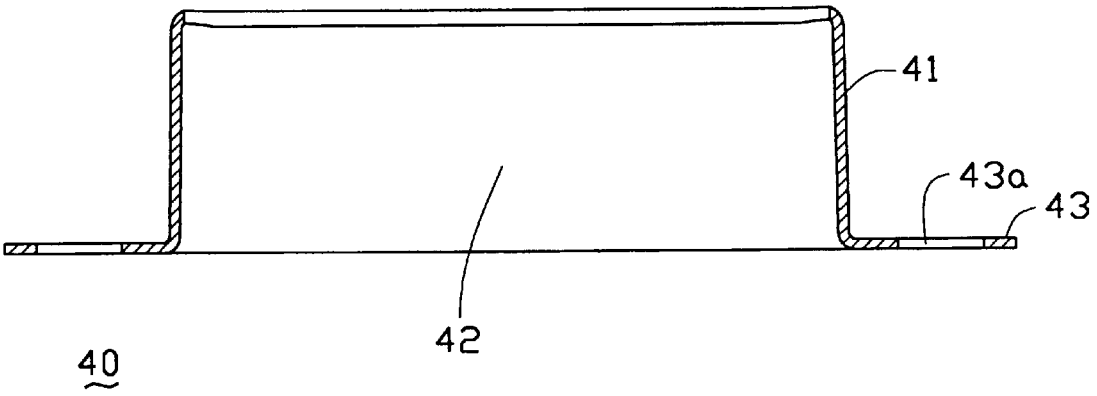
FIG. 3B is a cross sectional view of FIG. 3A.
Figure 4B:
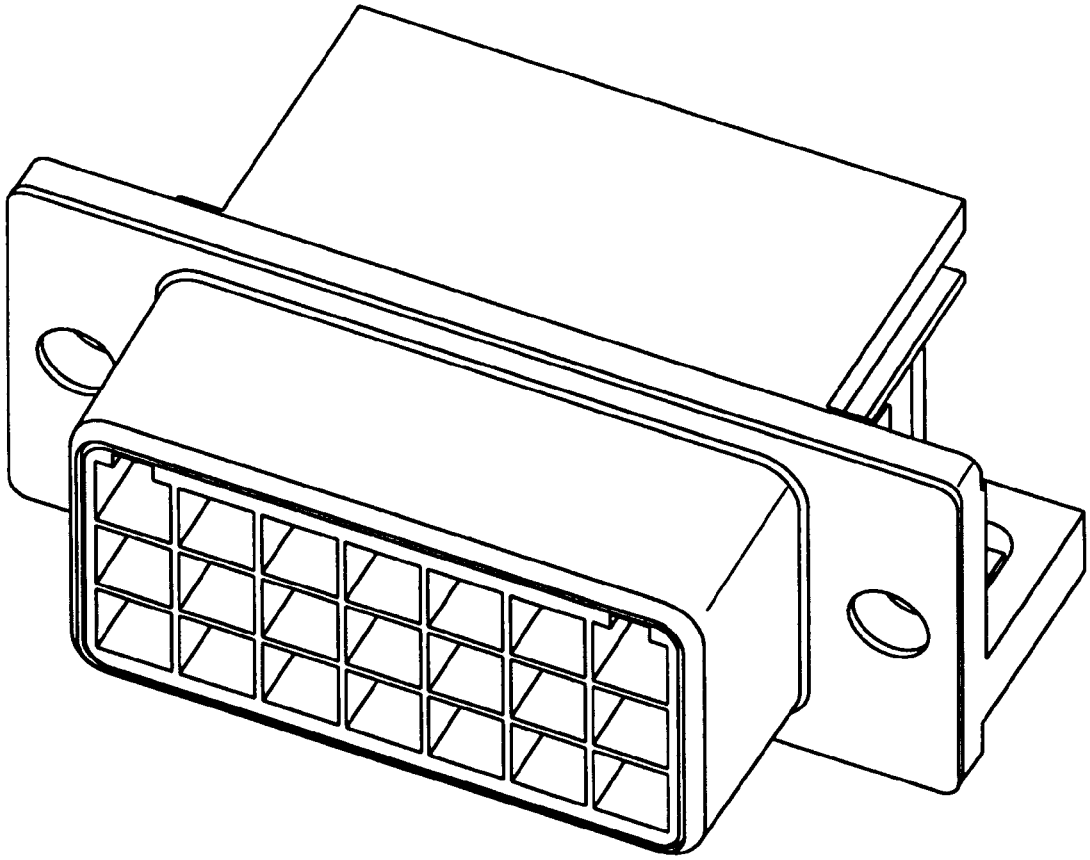
FIG. 4B is a perspective view of the second connector of FIG. 4A with the third EMI shield assembled thereto.

Referring to FIGS. 3A, 3B and 4, a third EMI shield 40 is assembled to a second connector 50. The second EMI shield 40 includes a third shroud portion 41 defining a third receptacle 42 therein for shielding a housing 51 of the second connector 50. The third EMI shield 40 includes a base flange 43 transversely extending from a bottom periphery thereof. The base flange 43 defines a pair of holes 43*a* for the extension of locking bolts 91 therethrough.

The housing 51 defines a plurality of receiving cells 52 for receiving the corresponding sleeve members 34 of the first connector 30. A wall 51*a* of the housing 51 defines with two key slots 52*a* for mating with the keys 34*b* of the corresponding sleeve members 34. By this arrangement, incorrect orientation between the first and second connectors 30, 50 can be eliminated. The second connector 50 forms a supporting flange 53 defining holes 53*a* therein for riveting the third EMI shield 40 thereto. A plurality of terminal pins 72 are assembled in the second housing 50 and each extends into the corresponding receiving cell 52 for electrically connecting with the related terminal 71 when the first and second connectors 30, 50 are assembled together. The second connector 50 is assembled to a printed circuit board (not shown) and the supporting flange 53 is securely assembled to a panel 80 of a chassis (not shown).

Figure 5A:
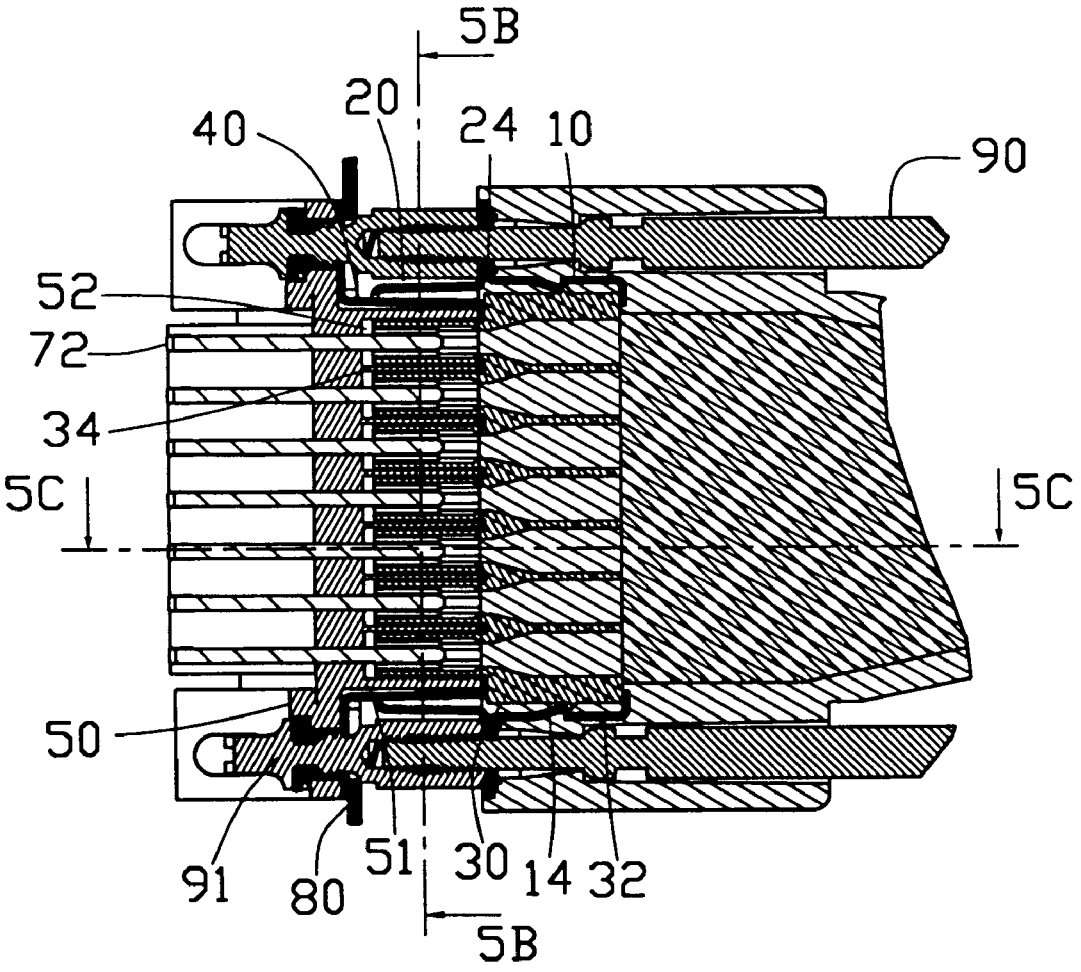
FIG. 5A is a cross sectional view of an assembly of the first and second connectors wherein only second connector shows terminals thereof.
Figure 5B:
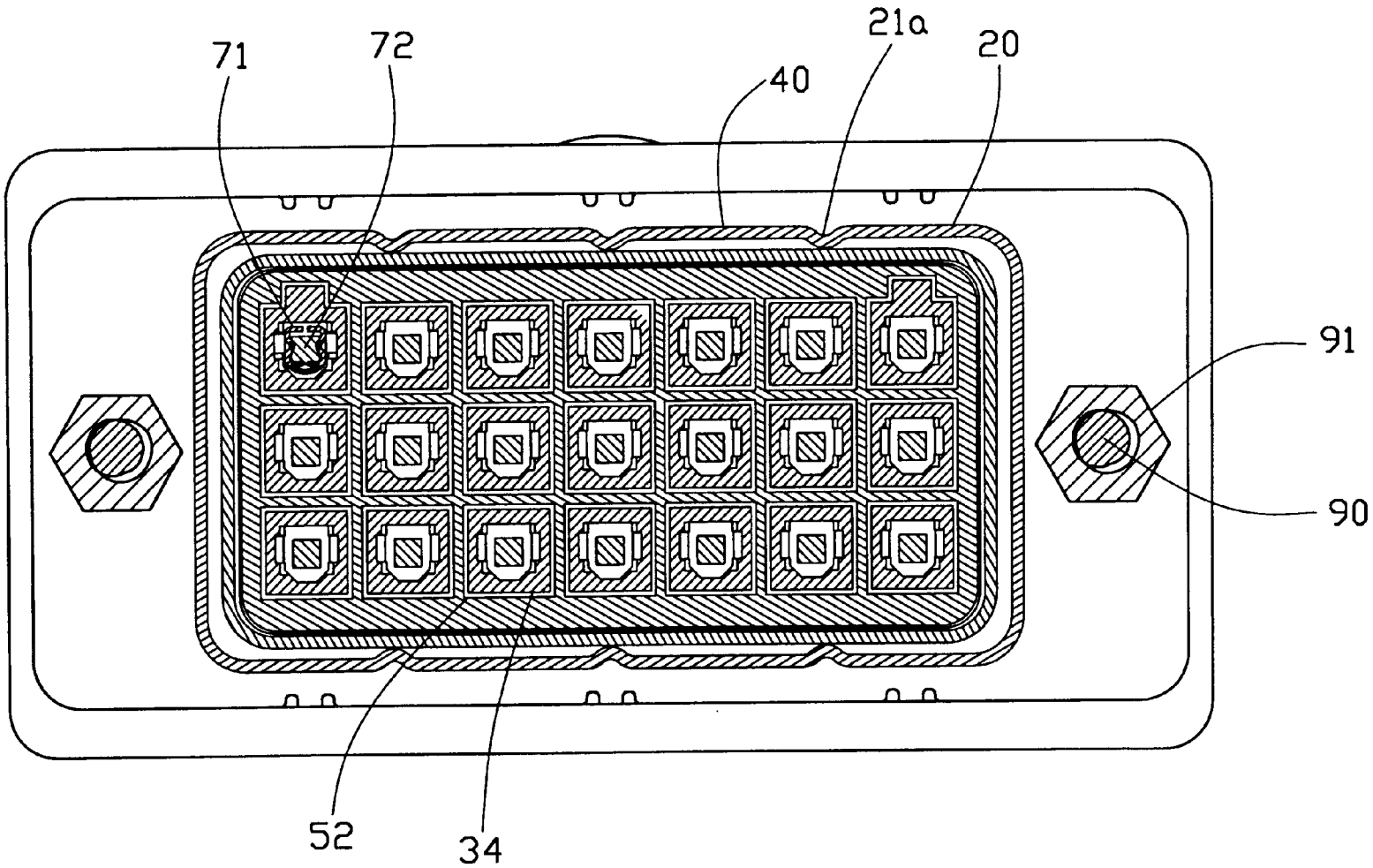
FIG. 5B is a cross sectional view taken along line 5B—5B of FIG. 5A wherein one terminal of the first connector is shown to illustrate engagement between the terminal of the first connector and the terminal of the second connector.
Figure 5C:
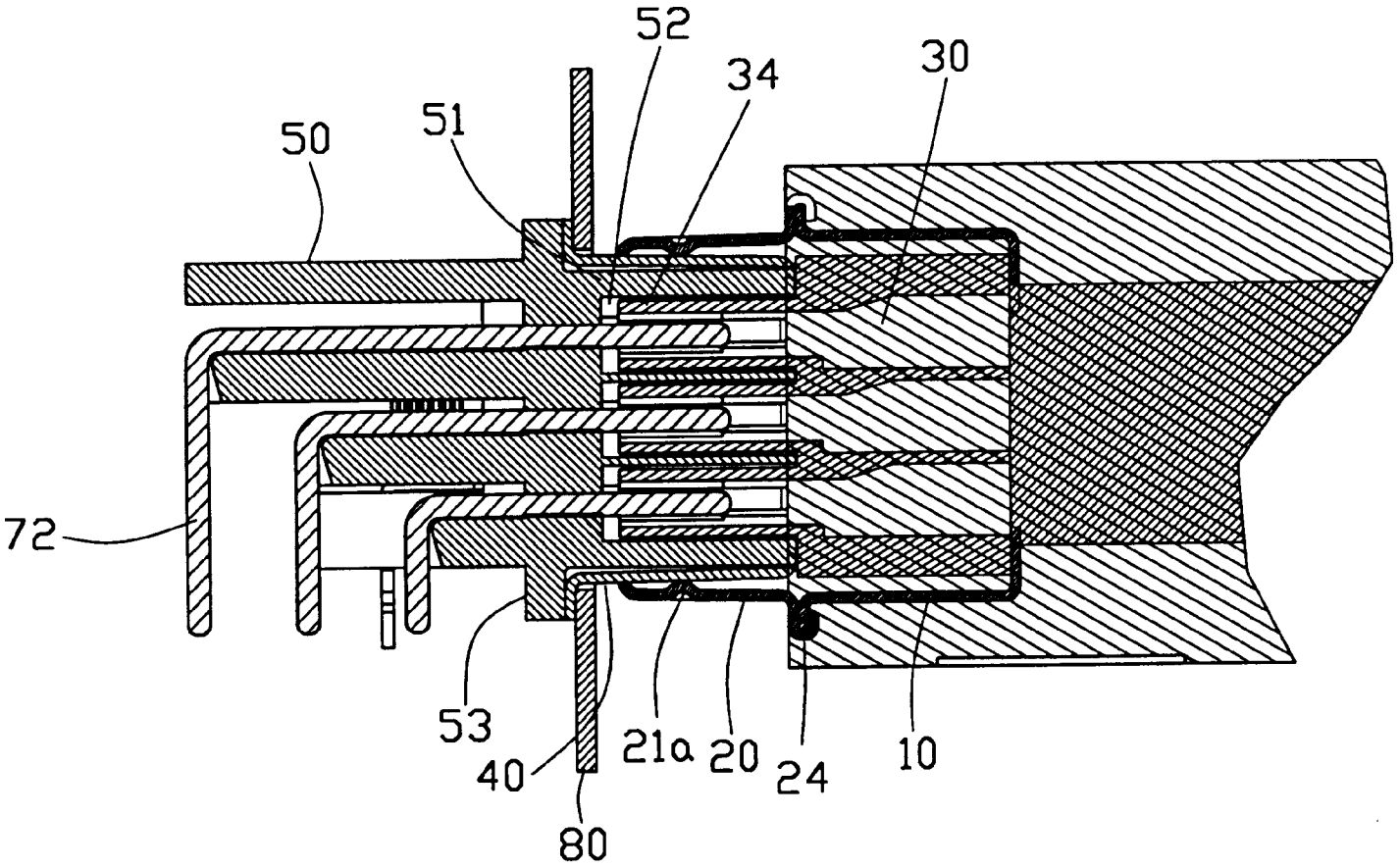
FIG. 5C is still a cross sectional view taken along line 5C—5C of FIG. 5A.

Referring to FIGS. 5A, 5B and 5C, when the first connector 30 is assembled to the second connector 50, the wall 51*a* of the housing 51 is received within the gap defined between the array of sleeve members 34 and the second EMI shield 20, and the sleeve members 34 are inserted into the receiving cells 52 of the second connector 50. In addition, before the terminal pins 72 electrically connect with the terminals 71, the dimples 24 of the second EMI shield 20 contact with the third shroud portion 41 of the third EMI shield 40.

Another important feature of the invention is the arrangement of these plural matrix type connector assemblies. As well known, generally most popularly used matrix type connectors are of a so-called two-row form due to preventing mismating between the sleeve members of the male connector and the receiving cells of the female connector. The background of the prevention of mismatching can be referred to the copending applications Ser. Nos. 09/075,508 filed May 8, 1998 and 09/152,037 filed Sep. 11, 1998 with the same inventor.

Anyhow, recently it is required to have eight cable units each including a male connector with, for example, twenty terminals therein for transmission. At the same time, as mentioned before, the corresponding eight complementary female connectors each with the same number of terminals, i.e., twenty terminals, should be side by side arranged along a lengthwise direction within a so-called bay envelope. Under this situation, if two-row matrix type female connectors are still used, each female connector should be designed to a 2×10 arrangement to meet 20 contacts requirement wherein 2 represents two rows and 10 represents 10 columns. Unfortunately, due to the limited space defined in the internal space of the enclosure, the panel cooperating with the female connector, is limited to have a lengthwise dimension only with 17". In fact, eight (2×10) female connectors of side-by-side arrangement will exceed 17" along the lengthwise direction. It should be noted that because this application includes power transmission, it is improper to reduce the dimension or the pitch of the terminals to minimize each (2×10) connector along the lengthwise direction for compromise with the panel dimension.

Based on this conflict situation, the invention provides a three-row matrix type female connector arrangement to meet the requirements of eight cable unit each with a male connector having 20 terminals therein under a dimension limitation of 17" along the lengthwise direction of the panel, wherein each three-row matrix connector, through means as defined in the aforementioned two copending applications, can be foolproof for preventing mismatching with the incorrect male connector of the cable unit which may fit for the previous two-row complementary female connector and has a different column number to the current female connector. Through three-row arrangement of each female connector, only seven columns are required thereof and thus the lengthwise dimension can be reduced. Accordingly, the whole lengthwise dimension of eight side by side positioned (3×7) female connectors will not exceed the maximum limitation 17". It is also appreciated that for each female connector, according to the arrangement method used in the invention, the column number should be kept with a minimum value to cooperate with the number of the row, so that the total number of the terminals of the female connector by multiplication of the row number and the column number should be not less than the total desired/required terminal number of each cable unit. In the current embodiment, a three-row (3×7=21) female connector is chosen to replace the original two-row (2×10=20) female connector. Once the new arrangement of the female connectors are decided, the complementary male connector of the cable unit should adopt the same format, i.e., 3×7 in this embodiment.

In conclusion, under a requirement of mating with N male connectors each with M terminals, the invention provides a method of side by side arranging N female connectors along a lengthwise direction wherein each of those N female connectors is of a matrix type composed of three rows and L columns under the condition that 3×L is not less than M, the lengthwise dimension of the (3×L) female connector is smaller than that of two-row female connector, of which the number of terminals thereof is equal to M, whereby the total lengthwise dimension of the N female connectors can match the limited lengthwise space while the two-row connectors can not.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. An EMI shield, comprising:

a shroud portion defining a receptacle for receiving a mating portion of an inserted complementary connector;

a first flange portion laterally extending around a bottom periphery of said shroud portion, said flange defining a plurality of holes for extension of locking bolts therethrough; and an aligning device integrally formed on said shroud portion and projecting into said receptacle for abutting against outer wall of a housing of said inserted complementary connector, said aligning device including a plurality of biasing tabs formed on at least of opposite walls of said shroud portion.

2. An EMI shield as recited in claim 1, wherein a second flange portion inwardly extends from a top periphery of said shroud portion defining a window therein.

3. An electrical connector, comprising:

a dielectric housing having a mating face and a rear face opposite said mating face, an array of passageways defined between said mating and rear faces;

an array of sleeve members extending from said mating face, each sleeve member defining a terminal receiving cavity therethrough aligned and communicating with said corresponding passageway;

a first EMI shield including a first shroud portion defining a first receptacle for receiving said dielectric housing, a first flange portion laterally extending from a bottom periphery of said first shroud portion, said first flange defining a plurality of holes for mounting said connector to an appropriate structure; and interengaging means formed between said dielectric housing and said EMI shield for retention of said dielectric housing within said EMI shield, said interengaging means including abutting tabs formed on walls of said first shroud portion and ribs formed on outer walls of said dielectric housing.

4. An electrical connector as recited in claim 3, further comprising a second EMI shield assembled to said first EMI shield.

5. An electrical connector as recited in claim 4, wherein said second EMI shield includes a second shroud portion defining a second receptacle for receiving said sleeve members of said dielectric housing.

6. An electrical connector as recited in claim 4, wherein said second EMI shield includes a flange portion laterally extending from a bottom periphery of said second shroud portion.

7. An electrical connector as recited in claim 6, wherein said flange portion of said second shroud portion forms clips thereon for engaging with said first flange portion of said first shroud portion.

8. An electrical connector assembly, comprising:

a first connector, including a first dielectric housing having a mating face and a rear face opposite said mating face, an array of passageways defined between said mating and rear faces, an array of sleeve members extending from said mating face, each sleeve member defining a terminal receiving cavity therethrough aligned and communicating with said corresponding passageway;

a first EMI shield assembly assembled to said first connector, said first EMI shield assembly including a first shroud portion defining a first receptacle for receiving said first dielectric housing, and a second shroud portion defining a second receptacle for receiving said sleeve members of said first connector;

a second connector detachably assembled to said first connector, said second connector including a dielectric housing having a mating face and a rear face opposite to said mating face, said dielectric housing defining a plurality of terminal cell corresponding said array of sleeve members, said dielectric housing including a flange portion laterally extending from said housing; and a second EMI shield interlocked to said second connector including a third shroud portion defining a receptacle for receiving said dielectric housing of said second connector, said third shroud portion being electrically engaged with said second shroud portion when said first and second connectors are assembled together.

9. the electrical connector assembly as recited in claim 8, wherein interengaging means is formed between said first dielectric housing and said first EMI shield for retention of said first dielectric housing within said first EMI shield.

10. An electrical connector assembly as recited in claim 9, wherein said interengaging means includes biasing tabs formed on side walls of said first shroud portion.

11. An electrical connector assembly as recited in claim 9, wherein said interengaging means includes ribs formed on outer walls of said dielectric housing.

12. An electrical connector, comprising:

a dielectric housing having a mating face and a rear face opposite said mating face, an array of passageways defined between said mating and rear faces;

an array of sleeve members extending from said mating face, each sleeve member defining a terminal receiving cavity therethrough aligned and communicating with said corresponding passageway;

a first EMI shield including a first shroud portion defining a first receptacle for receiving said dielectric housing, a first flange portion laterally extending from a bottom periphery of said first shroud portion, said first flange defining a plurality of holes for mounting said connector to an appropriate structure;

a second EMI shield interlocked to said first EMI shield, including a second shroud portion defining a second receptacle for receiving said sleeve members of said dielectric housing; and interengaging means formed between said dielectric housing and said EMI shield for mention of said dielectric housing within said EMI shield.

* * * * *